United States Patent [19]

Rothchild

[11] Patent Number: 4,625,736

[45] Date of Patent: Dec. 2, 1986

[54] METHOD AND APPARATUS FOR EXPANDING TOBACCO WITH WATER

[76] Inventor: Ronald D. Rothchild, 106 Rynda Rd., South Orange, N.J. 07079

[21] Appl. No.: 513,428

[22] Filed: Jul. 13, 1983

Related U.S. Application Data

[63] Continuation-in-part of Ser. No. 304,713, Sep. 23, 1981, abandoned.

[51] Int. Cl.[4] ..... A24B 3/18

[52] U.S. Cl. ..... 131/296; 131/302; 131/304; 131/305; 131/306

[58] Field of Search ..... 131/305, 306, 296, 300, 131/302, 303, 304, 241

[56] References Cited

U.S. PATENT DOCUMENTS 4,195,647 1/1980 Wochnowski ..... 131/296

*Primary Examiner*—V. Millin

*Attorney, Agent, or Firm*—Hopgood, Calimafde, Kalil, Blaustein & Judlowe

[57] ABSTRACT

A method and preferred apparatus for expanding moisture containing tobacco. Tobacco is very rapidly heated by a stream of heated gas, by contacting a high speed downdraft flow of said gas with said tobacco while said tobacco is in transit on a gas porous conveyer. The conveyer is preferably configured as a cylindrical drum with a gas porous cylindrical surface, rotating about its axis.

10 Claims, 2 Drawing Figures

METHOD AND APPARATUS FOR EXPANDING TOBACCO WITH WATER

CROSS-REFERENCE TO RELATED APPLICATION

This application is a continuation-in-part of my application Ser. No. 304,713 entitled "PROCESS FOR EXPANDING TOBACCO WITH WATER", filed Sept. 23,. 1981 now abandoned.

BACKGROUND OF THE INVENTION

The present invention relates to expansion of tobacco by intense convection heating of moisture-containing tobacco, in a gas which may have steam as its major component, and to apparatus particularly well suited for that purpose.

U.S. patent application Ser. No. 304,713, entitled Process for Expanding Tobacco with Water, describes a process wherein moisture containing tobacco is very rapidly heated by means of a high speed downdraft of hot gas while said tobacco is transported on a conveyer with a porous belt. Said conveyer is therefore a feature of said process, and not just a means of transport.

U.S. Pat. No. 3,957,063 illustrates the use of two different types of conveyers in tobacco processing; vibrating and belt types. An updraft gas flow is directed through said vibrating conveyer, which has a porous pan. Said belt conveyer, however, is of conventional construction with its belt suspended between and driven by multiple rollers, and it is not porous.

U.S. Pat. No. 4,091,824 illustrates a belt conveyer, with a porous belt but also suspended between and driven by multiple rollers.

U.S. Pat. No. 3,982,550 describes a typical prior art dryer for the expansion of moisture-containing tobacco by means of very rapid heating. Said tobacco is heated by a hot gas while said tobacco is in pneumatic transport in a flow of said gas.

There are economic and smoking product design reasons for expanding tobacco in several different forms, e.g. stem and lamina. A process based on that described in U.S. patent application Ser. No. 304,713 is usable with virtually all of said forms of tobacco, and said process is operable with a wide variety of process conditions. Said process conditions may be extreme including high temperature and very short residence time, with said short residence time leading to a requirement for relatively high speed of said porous conveyer belt.

Said "belt" must further be of complex construction including a layer porous to gas flow but capable of supporting and restraining tobacco particles from moving with said gas. Said porous layer must either be structurally strong or must be supported on a second layer that does provide said structural strength. Moreover conventional lubrication is precluded by purity requirements of said tobacco, and some synthetic bearing materials, that could withstand both said high temperature and the absence of said lubrication, are likewise precluded, while said multiple layers will cause greater than usual internal friction.

There is therefore a need for a process conveyer, for use as a downdraft conveyer expansion dryer, that can operate reliably, unlubricated at high speed and temperature, providing very short residence time.

SUMMARY

This disclosure relates to a process for expanding moisture containing tobacco in which said tobacco is rapidly heated by contact with a moving stream of heated gas, by contacting a high speed downdraft flow of said gas with said tobacco while said tobacco is in transit on a gas-porous conveyer. The relative velocity between said gas and said tobacco particles should preferably be greater than the corresponding relative velocity between substantially similar gas and tobacco particles in a transport dryer, which would be about 5–15 ft/sec with variation due in part to the form and size of tobacco particles.

The temperature of said heated gas should be in the range of about 230° F. to 800° F., and preferably in the range of about 250° to 600° F. The residence of said tobacco in said downdraft flow on said conveyer should be at least about 0.5 seconds.

Said conveyer should preferably be reduced to the form of a single cylindrical drum with horizontal axis, with said drum caused to rotate about said horizontal axis, with the cylindrical surface of said drum being porous to gas flow but capable of preventing any significant flow of tobacco therethrough, and with at least one of its ends being open to gas flow.

Said downdraft gas flow should preferably be from the outside to the inside of said cylinder through said porous surface. Said tobacco should preferably reside in said downdraft gas flow while being transported on the outside of said cylindrical surface over a portion of its rotation, such as about 90°.

Said drum should be contained in a housing, and said tobacco may be introduced into said housing and onto said drum through a well known rotary valve. Said tobacco should preferably be removed from said drum, following its residence in said downdraft flow, by a well known doctor blade, or a local region of high speed updraft through said porous surface surface, or by a combination of the two. Following its removal from said drum, said tobacco may be removed from said housing through an exit rotary valve.

FIG. 1 is an external isometric view of the drum-configured conveyor dryer in accordance with a preferred embodiment of the invention and FIG. 2 is an interior view of the conveyor dryer showing its internal configuration.

DETAILED DESCRIPTION OF THE INVENTION

Figure 1:
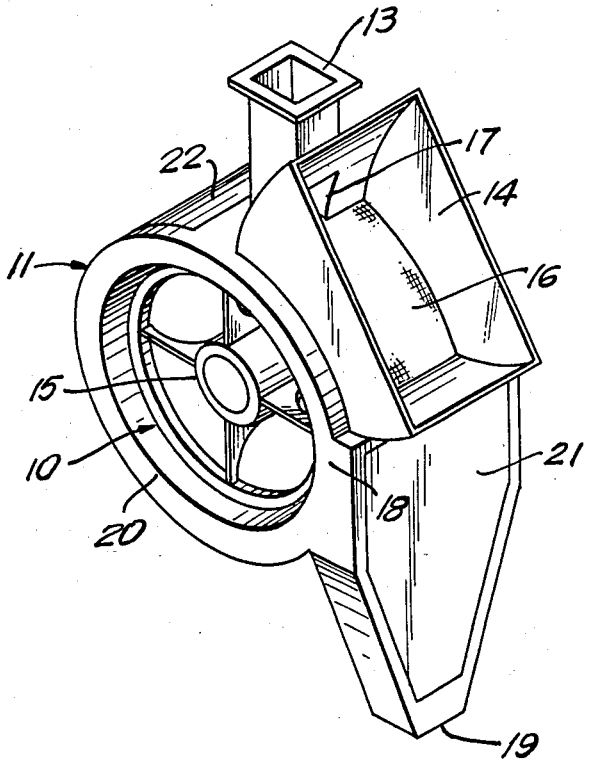

Tobacco in its various forms can be significantly and usefully expanded with water as a propellant and expanding agent, provided that the heating of said tobacco is sufficiently rapid. The presence of steam in high concentration is also helpful in some cases, partly to protect said tobacco against oxidation at high temperatures, and partly to improve the degree of said expansion.

Tobacco which is significantly expanded in this way, such as tobacco which may have contained about 20% moisture before expansion by rapid heating, chars very easily if in contact with air. However tobacco which is processed identically but which contained less moisture before processing, such as about 10% to 13%, and therefore was not as highly expanded, chars less or not at all even though exposed to the same temperature for the same length of time. It therefore appears that very high expansion may include temporary changes in said tobacco at the molecular level, such as the opening of chemically active sites, which react very readily with any oxygen present. The presence of a high concentration of steam helps to prevent this charring.

This invention relates to achievement of very rapid heating of tobacco, sufficiently rapid to effect a high degree of expansion, by means of a high rate of primarily convective heat transfer from a hot gas to said tobacco. Said high rate of heat transfer may be obtained either by maintaining a high temperature differential between said gas and tobacco, or by maintaining a high heat transfer coefficient, or by a combination of these conditions.

It is also desirable that the duration of heating be limited and precisely controllable so as to avoid drying said tobacco excessively, and to limit the maximum temperature of said gas to which said tobacco is exposed in order to avoid thermal degradation of said tobacco even in the absence of air. Said gas temperature should be no greater than about 800° F., and preferably below about 600° F., if said gas is an inert gas such as steam. Said gas temperature should be below about 400° F., and preferably below about 300° F., if said gas is air.

The requirements and constraints described above are best met by heating said tobacco with a high speed downdraft of said gas while said tobacco is in transit across the flow of said gas on a porous conveyer. When heated in this crossflow manner, said tobacco is heated by said gas at its peak temperature during the entire residence of said tobacco in said downdraft, which provides the maximum temperature differential between said gas and said tobacco for any given level of peak gas temperature. The duration of said heating is precisely determined, by the speed of said conveyer in combination with the length of the zone in which said tobacco is contacted by said downdraft. Said duration should be at least about 0.5 seconds to significantly expand said tobacco, but preferably less than about 8 seconds to avoid excessive drying.

Said downdraft heating on said conveyer also permits the attainment of high relative velocity between said gas and said tobacco, since said tobacco is effectively stationary with respect to said gas flow and said relative velocity is approximately equal to said gas velocity. This is in contrast to well known high-intensity tobacco dryers which operate with said tobacco fluidized or in fluid transport. The relative velocity between said gas and particles of said tobacco in such prior art dryers is limited to the gas velocity capable of supporting transport of said tobacco in said gas, during most of the duration of said heating in said prior art dryers. Said transport velocity of said tobacco in said gas is typically about 5 ft/sec to 15 ft/sec, depending on the size and form of said tobacco particles and on the properties of said gas. Improved expansion is obtained by maintaining said relative velocity greater than said transport velocity with similar gas and tobacco particles in a transport dryer.

Preferably, said relative velocity is in the range of 15 ft/sec to 150 ft/sec. Substantially similar results can be obtained with a combination of higher relative velocity and lower gas temperature as with an appropriate combination of lower relative velocity and higher temperature. In adjusting parameters to achieve a desired degree of expansion of said tobacco, it is generally preferable for reasons of product quality to utilize a lower temperature and higher relative velocity.

It is also important that no substantial flow of said gas be permitted around the edges of said conveyer, and that substantially all of said flow be directed through said porous conveyer belt. Any significant leakage of said gas around said belt may entrain and transport a portion of said tobacco off, around and past the surface of said belt, which is to be avoided.

There are practical considerations which limit the suitability of conventional types of conveyers for service as high speed downdraft expansion dryers.

Said tobacco must be supported on a surface which is permeable to said gas, yet prevents movement of said tobacco therethrough. Said surface may be, for example, a fine stainless steel screen such as about 50 mesh, with the maximum practical open area. However said screen with maximum practical open area is constructed of very fine wire and does not have significant mechanical strength. Therefore said screen portion of a porous conveyer belt must itself be supported on a structurally stronger belt. At any moment, some portion of said belt will be flat and other portions will be curved around conveyer rollers, and the geometry of any portion of said belt will continuously change between the two states as said conveyer moves, leading to significant internal friction and wear between said screen and structural belt in the hot environment. Lubrication is difficult, in part due to the environment and in part to avoid contaminating said tobacco product.

The same consideration of friction and wear applies to said structural belt itself, which is typically built up of a series of rigid links hinged together in some fashion and which must in this case operate in a hot environment without lubrication, and at high speed in order to limit the residence time of said tobacco in said heating zone. For example if said residence is 3 seconds and said heating zone 6 ft long, said belt must move at 2 ft/sec, which is high for standard belts in high temperature service where velocity is more typically measured in ft/minute.

Said structural belt must also offer minimum restriction to the passage of said gas therethrough, and must itself be supported in such a way that its motion and the passage of gas therethrough are not impeded.

Said belt may also need to have substantial surface area within said heating zone, which further complicates and restricts its geometry in view of said requirement for short residence time combined with said practical limits on belt speed.

All of the above described difficulties are overcome by configuring said conveyer in the form of a cylindrical drum, with its cylindrical surface being porous to said gas flow but impermeable to said tobacco, and with at least one end of said cylinder being open. Said cylinder rotates on its axis so that the motion of said cylindrical porous surface is circular about said axis and said heating zone may preferably comprise a portion of the circumference of said cylindrical drum, such as preferably about 90° in a fixed location through which said drum rotates, over substantially the entire length of the porous portion of said cylindrical surface in the direction parallel to said axis.

The required belt speed is easy to achieve without undue strain on equipment with said conveyer being configured as a drum. For example if said heating zone comprises 90° of the rotation of said drum, and if residence time is 3 seconds, said drum must be made to rotate at 5 revolutions per minute, which is easy to achieve, without friction or wear as there are no moving parts other than the entire drum assembly as a unit.

Said cylindrical drum is preferably supported on a shaft concentric with said drum axis, and oriented horizontally. Said shaft is preferably mounted on bearings located outside the housing of said conveyer dryer, in a ambient or less extreme temperature conditions. Since said shaft penetrates the wall of said housing, said gas inside said conveyer dryer should preferably be isolated from the outside atmosphere at the location of said penetration with a well known rotary shaft seal.

Said tobacco is preferably introduced into said housing through a well known rotary valve, and deposited on said cylindrical surface near the top of its circumference. Said tobacco should then preferably reside on said drum during about 90° of its rotation following which it may be removed from said drum with a doctor blade or a strong, local updraft of said gas through said porous surface, or a combination of the two.

If said local updraft is used to assist in removal of said tobacco from said surface, a separation device such as a well known tangential separator will be required to remove said tobacco from the gas of said updraft before said tobacco exits said housing. Removal of said tobacco from said housing, after separation from said updraft gas if required, is preferably through a well known rotary valve.

Said downdraft of hot gas to perform said expansion of said tobacco is perferably directed radially inward, toward said axis of said drum and through its porous cylindrical surface. Said downdraft should be fairly evenly distributed over said heating zone, the segment of said cylindrical surface comprising the angular travel of said surface between the introduction of said tobacco and its removal, or preferably a major portion of said segment, over the effective length of said surface in the direction parallel to its said axis.

At least one end of said drum is perferably left open, to allow unrestricted exit of said hot gas after it has passed through said porous cylindrical surface, in said heating zone, into the interior of said drum. If said end of said drum is not left open, and said gas must exit said drum through a section of said porous surface outside of said heating zone, the motor power required to circulate said gas will be higher due to the additional pressure to force said gas a second time through said porous surface.

Upon being withdrawn from the interior of said drum, said gas is preferably reheated and recirculated back to be directed in a downdraft flow into said drum again.

Said cylindrical drum is the preferred form for said conveyer due to practical advantages conferred by that configuration. However said drum may in principle be mapped into the form of some other substantially rigid, porous surface rotated about a single axis, such as a disc or cone, with said heating zone comprising a segment in the rotation of any such surface.

DETAILED DESCRIPTION OF THE PREFERRED EMBODIMENT

FIG. 1 shows an external isometric view of said drum-configured conveyer dryer, with external equipment such as accessories and ducting omitted to facilitate visualization of said dryer's novel features. The primary components of said dryer are the drum 10 and its housing 11.

Said drum 10 has a 50 mesh stainless steel screen about most of its cylindrical surface 16, said screen being supported by a structurally stronger grating, not shown, also cylindrical. Said cylindrical grating is mounted about shaft 15 which is supported on external bearings and caused to rotate by an external motor, not shown.

Tobacco enters said dryer through a rotary valve, not shown, at the tobacco inlet 13 and falls onto the cylindrical surface of drum 10 near the apex of its travel. The chute through which said tobacco falls onto said surface communicates with the duct 14 through which hot gas is directed as a downdraft into said screen 16, at 17. In this way the flow of said gas through duct 14 assists gravity in moving said tobacco onto said screen to permit intense heating of short duration.

Said tobacco is removed from screen 16 at about the 3 o'clock position of drum 10, approximately as indicated at 18. After removal from screen 16 tobacco falls by gravity through tobacco outlet 19 to an outlet rotary valve, not shown. Access doors are provided at 21 and 22 to allow entrance to housing 11 for assembly and maintenance. Gas leaves housing 11 and the inside of drum 10 through the open end of said drum and outlet port 20 in said housing.

Figure 2:
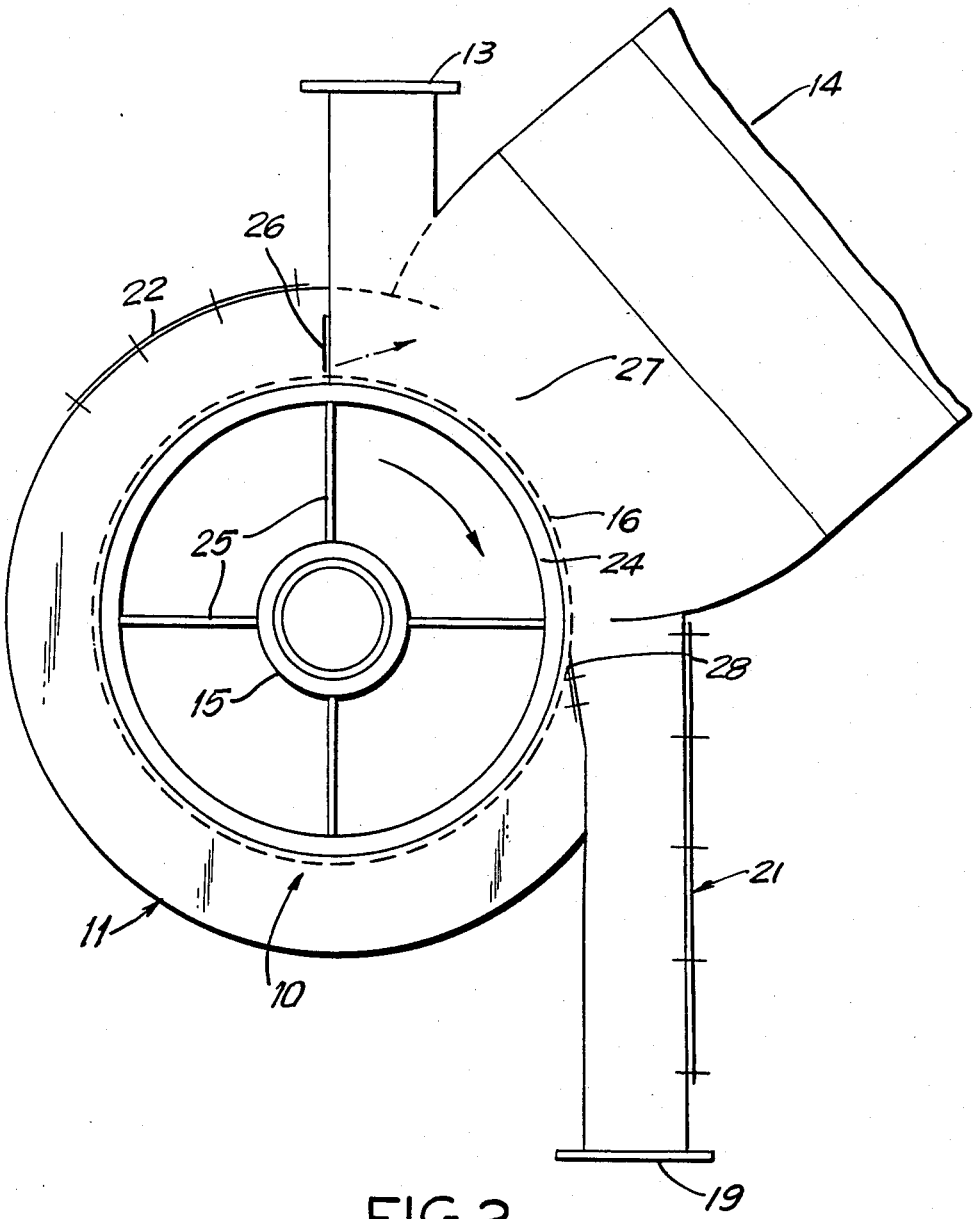

FIG. 2 shows a view of the interior of said dryer with additional detail. Drum 10 rotates clockwise on shaft 15, as indicated by direction marker, within housing 11. Tobacco enters at inlet 13 and exits housing 11 at outlet 19. Hot gas is directed in downdraft flow radially into drum 10 through duct 14. Said hot gas flows through screen 16 and through cylindrical grating 24 on which screen 16 is supported, to the interior of drum 10. Grating 24 is mounted on shaft 15 by means of vanes 25. Access doors are shown in housing 11 at 21 and 22. A barrier 26 prevents flow of gas or tobacco backward away from heating zone 27, which is defined as between barrier 26 and doctor blade 28. Doctor blade 28 serves similarly as a barrier at one end of heating zone 27, and also removes tobacco from screen 16 so that it falls by means of gravity to outlet 19.

The following examples illustrate the results which are obtained by means of said downdraft heating for the expansion of tobacco. In all cases, expanded tobacco was left for one week in an open dish to reach moisture equilibrium with the ambient atmosphere before measuring its filling power, and an unexpanded control was also left to equilibrate. Filling power, or cylinder volume, of the expanded sample and control were measured by placing a sample of the material in a 100 cc graduate, compressing it under a piston at 2.7 psi, and reading its volume.

In all of the following examples, tests were conducted with a bed of tobacco about ¼ inch deep supported on a section of 50 mesh screen, with hot gas directed downward through said bed and screen. Tobacco was of the flue-cured variety, comprising either cut lamina or particles of size-reduced stem material with its cell structure largely intact.

EXAMPLE 1

A sample of lamina containing about 18% moisture was contacted with a gas consisting almost entirely of steam, the temperature of said gas being about 700° F. and its velocity being about 10 ft/sec, for about 4 seconds. Cylinder volume of the sample when equilibrated was 26 cc/2.5 g. Cylinder volume of the control was 13.5 cc/2.5 g. Expansion was over 90%.

EXAMPLE 2

A sample of lamina containing about 18% moisture was contacted with a gas containing over about 80% steam, the temperature of said gas being about 600° F. and its velocity being about 15 ft/sec, for 4 seconds. Cylinder volume of the sample when equilibrated was 25 cc/2.5 g. Cylinder volume of the control was 13.5 cc/2.5 g. Expansion was about 85%.

EXAMPLE 3

A sample of lamina containing about 18% moisture was contacted with a gas containing over about 60% steam, the temperature of said gas being about 500° F. and its velocity being about 30 ft/sec, for about 4 seconds. Cylinder volume of the sample when equilibrated was 25 cc/2.5 g. Cylinder volume of the control was 13.5 cc/2.5 g. Expansion was about 85%.

EXAMPLE 4

A sample of lamina containing about 13% moisture was contacted with hot air at about 350° F., the velocity of said air being about 35 ft/sec, for about 4 seconds. Cylinder volume of the sample when equilibrated was about 16.5 cc/2.5 g. Cylinder volume of the control was 13.5 cc/2.5 g. expansion was over 20%.

EXAMPLE 5

A sample of stem containing about 17% moisture was contacted with heated air, the temperature of said air being about 280° F. and its velocity being about 30 ft/sec, for about 3 seconds. Cylinder volume of the sample when equilibrated was 13 cc/g. Cylinder volume of the control was 8 cc/g. Expansion was about 60%.

EXAMPLE 6

Same as Example 5, except stem was heated for only 2 seconds. Cylinder volume of the sample when equilibrated was 11 cc/g. Expansion was about 37%.

EXAMPLE 7

Same as Example 5, except air temperature was about 250° F. Cylinder volume of the sample when equilibrated was 10 cc/g. Expansion was about 25%.

EXAMPLE 8

A sample of stem containing about 11% moisture was contacted with heated air under the same conditions as Example 5. Cylinder volume of the sample when equilibrated was 10 cc/g. Cylinder volume of the control was 8 cc/g. Expansion was about 25%.

What is claimed is:

1. A method for expanding moisture containing tobacco in which said tobacco is very rapidly heated by contact with a moving stream of heated gas, such that the relative velocity between said gas and said tobacco particles is greater than the substantially similar gas and tobacco particles in a transport gas velocity sufficient to transport said particles in said gas, with said tobacco being subject to said very rapid heating for at least about 0.5 seconds following the introduction of said tobacco into contact with said gas stream.

2. The method of claim 1 wherein said stream of gas is at a temperature of about 230° to 800° F.

3. The method of claim 1 wherein said contact between said gas and said tobacco is accomplished by passing said gas in a downdraft through a bed of said tobacco on a porous surface.

4. The method of claim 1 wherein said relative velocity between said gas and said tobacco is from about 10 ft/sec to about 150 ft/sec.

5. A method for expanding moisture containing tobacco in which said tobacco is very rapidly heated by a stream of heated gas, by contacting a high speed downdraft flow of said gas with said tobacco while said tobacco is in transit on a gas-porous conveyer, the temperature of said stream of heated gas being about 230° to 800° F., and the residence of said tobacco in said downdraft flow on said conveyer being at least about 0.5 seconds following the introduction of said tobacco onto said conveyer.

6. The method of claim 5 wherein the velocity of said downdraft gas flow is about 10 ft/sec to 150 ft/sec.

7. The method of claim 1 wherein said tobacco initially contains at least about 10% moisture by weight.

8. A conveyer for the treatment of tobacco with a downdraft flow of gas, the improvement comprising:

a. A surface with circular symmetry about an axis, porous to gas but substantially impermeable to tobacco, b. Means to rotate said surface about said axis, c. Means to direct a flow of tobacco onto said surface at a first fixed station in said rotation, and to remove said tobacco from said surface at a second fixed station, so that said flow of tobacco resides on said surface for a segment of its rotation between said first and second fixed stations, d. Means for passing said downdraft flow through a portion of said segment in which said tobacco resides and is conveyed.

9. The apparatus of claim 8 further including means for inducing a local strong updraft gas flow through said surface at said second fixed station, to assist in said removal of said tobacco from said surface.

10. A method for expanding moisture containing tobacco in which said tobacco is very rapidly heated by a stream of heated gas, said gas comprising at least about 60% steam and the temperature of said gas being from about 300° to 800° F., while said tobacco is residing and being transported on a conveyor.

* * * * *